US007703255B1

(12) United States Patent
Norrid

(10) Patent No.: US 7,703,255 B1
(45) Date of Patent: Apr. 27, 2010

(54) WALL AND DOOR HOLE REPAIR KIT AND METHOD OF HOLE REPAIR

(76) Inventor: Robert Scott Norrid, 1916 S. Logan St., Denver, CO (US) 80210

( * ) Notice: Subject to any disclaimer, the term of this patent is extended or adjusted under 35 U.S.C. 154(b) by 70 days.

(21) Appl. No.: 12/074,522

(22) Filed: Mar. 4, 2008

(51) Int. Cl.
*E02D 37/00* (2006.01)

(52) U.S. Cl. ..... 52/514; 52/514.5; 52/516

(58) Field of Classification Search ..... 52/514, 52/514.5, 516
See application file for complete search history.

(56) References Cited

U.S. PATENT DOCUMENTS 4,354,332 A * 10/1982 Lentz ..... 52/514
4,406,107 A * 9/1983 Schoonbeck ..... 52/514
6,508,040 B2 * 1/2003 Nelson ..... 52/514
2002/0059767 A1 * 5/2002 Nelson ..... 52/514
2005/0086889 A1 * 4/2005 Shock ..... 52/514

* cited by examiner

*Primary Examiner*—Richard E Chilcot, Jr.
*Assistant Examiner*—Jessica Laux
(74) *Attorney, Agent, or Firm*—Edwin H. Crabtree; Ramon L. Pizarro

(57) ABSTRACT

A wall and door hole repair kit used for repairing a hole accidentally punched or intentionally cut during repair or remodeling of a wall or door. The repair kit includes a thin sheet first brace and a thin sheet second brace. A width of one or both braces is dimensioned for receipt inside the hole. Each of the two braces includes a round tube opening with a tube compression slit. The compression slits are disposed next to the tube openings. A small rubber or plastic tube is received through the tube openings in the first and second braces. An adhesive is applied to an inside surface of the first brace. The adhesive is used for securing the first brace to the inside of the wall or door and next to the hole. A portion of the tube is then inserted in the compression slits to hold the braces firmly against an inside and outside of the wall or door and next to the hole. When the adhesive dries, the second brace is removed and the hole is filed with wood putty, spackle and the like and using the first brace as a working surface inside the hole.

9 Claims, 4 Drawing Sheets

WALL AND DOOR HOLE REPAIR KIT AND METHOD OF HOLE REPAIR

BACKGROUND OF THE INVENTION (a) Field of the Invention

This invention relates to a repair kit used for repairing walls and doors and more particularly, but not by way of limitation, to a repair kit and method used to repair both small and large holes in a damaged area in a wall's sheet rock or in a hollow door.

(b) Discussion of Prior Art

Heretofore, a hole accidentally punched into a wall or door was difficult to repair since there was no workable surface inside the damaged area for adding wood putty, spackle and the like, unless the hole was extremely small. Obviously and until now, when repairing a large damaged area, the repair material would merely fall into a space inside the wall or door. The subject invention provides a working surface inside the hole for ease in repair.

SUMMARY OF THE INVENTION

In view of the foregoing, it is a primary objective of the subject invention to provide a hole repair kit and method for fixing a hole in a wall and door. The invention can easily be used by a do-it-yourself person or a professional handyman.

Another object of the invention is the repair kit can also be used for ceiling repair and other areas where an open space is behind a damaged area and a working surface inside the area is required.

The subject invention is a wall and door hole repair kit for repairing a hole in the wall or door. The repair kit includes a thin sheet first brace and a thin sheet second brace. A width of one or both braces is dimensioned for receipt inside the hole. Each of the two braces includes a round tube opening with a tube compression slit. The compression slits are disposed next to the tube openings. A small rubber or plastic tube is received through the tube openings in the first and second braces. An adhesive is applied to an inside surface of the first brace. The adhesive is used for securing the first brace to the inside of the wall or door and next to the hole. A portion of the tube is then inserted in the compression slits to hold the braces firmly against the inside and outside of the wall or door and next to the hole. When the adhesive dries, the second brace is removed and the hole is filed with wood putty, spackle and the like and using the first brace as a working surface inside the hole.

These and other objects of the present invention will become apparent to those familiar with the repair of holes in walls, floors and ceilings and like repair projects when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for its practical application and in which.

DETAILED DESCRIPTION OF THE PREFERRED EMBODIMENTS

Figure 1:
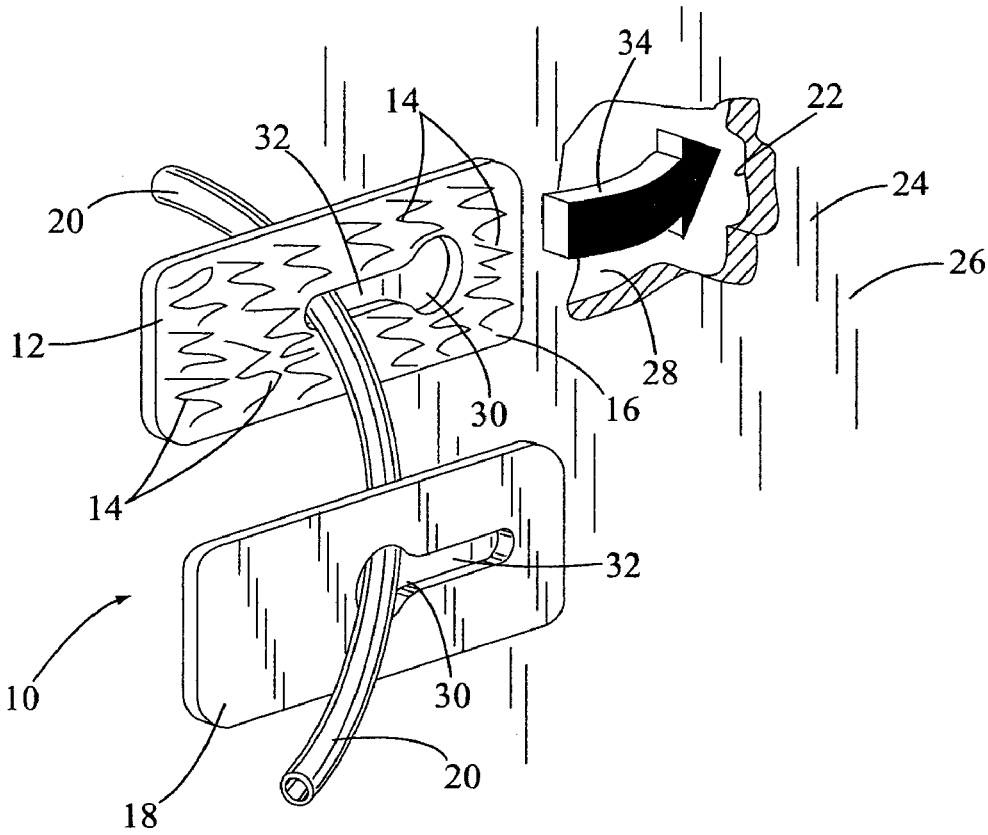
FIG. 1 is a perspective view of the wall and door hole repair kit with a thin sheet first brace with adhesive on an inside thereof, a thin sheet second brace and a compression tube. The repair kit is positioned for attaching to an inside and outside of a sheet rock wall. The wall is shown having a small hole that has been accidentally punched therein.

In FIG. 1, a perspective view of the wall and door hole repair kit is shown having general reference numeral 10. The repair kit 10 includes a thin sheet first brace 12 with an adhesive 14, such as glue, on an inside surface 16. Also, the repair kit 10 includes a thin sheet second brace 18 and a compression tube 20. The first brace 12 and second brace 18 are shown positioned for attaching to an inside 22 and an outside 24 of a sheet rock wall 26. While the sheet rock wall 26 is discussed herein, the repair kit 10 can be used equally well in the repair of a wooden door and other types of walls, doors, ceiling and like applications.

In this drawing, the wall 26 is shown having a small hole 28, which has been accidentally punched therein. A width of the first brace 12, typically in a range of 1 to 3 inches, is dimensioned for receipt inside the hole 28. The first and second braces 12 and 18 can have the same dimensions, such as 6 inches in length, 1 inch wide and ⅛ inch thick. Obviously, the braces 12 and 18 can have different dimensions for different sizes and shapes of holes, without departing from the spirit and scope of the invention. Also, the thin sheet braces can be cut or trimmed to size to fit inside the hole. Further, the tube 20 is typically 6 inches in length and has a ¼ inch diameter.

The two braces 12 and 18 include a round tube opening 30 with a tube compression slit 32. The tube opening 30 has a diameter the same or greater than the tube 20. The compression slits 32 are disposed next to the tube openings 30. The slits 32 can be ⅜ inches in length and 3/64 inches wide. In this drawing, the compression tube 20 is received through the tube opening 30 and pressed into the slit 32 for securing the first brace 12 on the tube 20 and prior to inserting the first brace 12 through the hole 28, as indicated by arrow 34. Also the tube 20 has been inserted through the tube opening 30 in the second brace 18.

Figure 2:
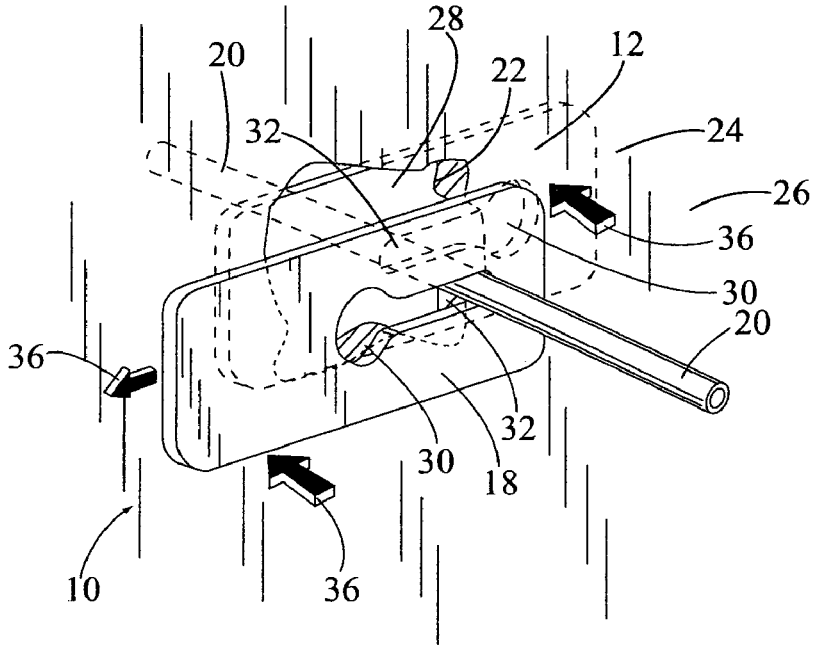
FIG. 2 is a perspective view of the first brace received through the hole and positioned against the inside of the wall and covering all or most of the inside of the hole to provide a working surface. The second brace is positioned for engaging the outside of the wall.

In FIG. 2, a perspective view of the first brace 12 is shown in dashed lines and received through the small hole 28 with the adhesive 14 pressed against the inside 22 of the wall 26. The first brace 12 is illustrated covering most or all of the inside of the hole 28 to provide a working surface therein. The tube 20 is now inserted into the compression slit 32 in the second brace 18. The second brace 18 is then adjusted, shown as arrows 36, tightly against the outside 24 of the wall 26 and covering the hole 28. In this manner, the second brace 18 holds the first brace 12, using the compression tube 20, firmly against the inside 22 of the wall 24 until the adhesive 14 is dried.

Figure 3:
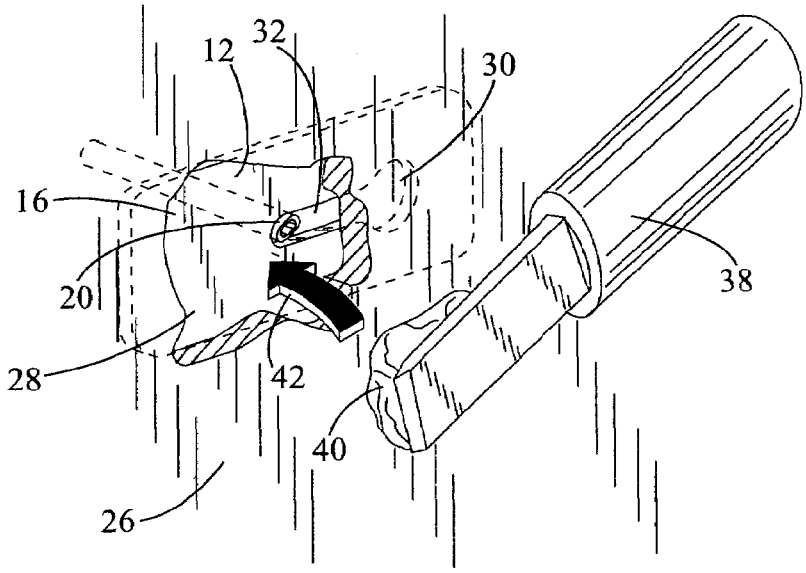
FIG. 3 is a perspective view of the first brace secured to the inside of the wall with the adhesive dried and the second brace removed. A spackle tool is shown with spackle thereon and positioned for filling the hole.

In FIG. 3, a perspective view of the first brace 12 is shown secured to the inside 22 of the wall 26 with the adhesive dried and the second brace 18 removed. By pulling the compression tube 20 tight and cutting it flush with the front of the wall 26, the tube 20 will spring back into the hole 28 out of the way. A spackle tool 38 is shown with spackle 40 thereon and positioned for filling the hole 28 and against a portion of the inside surface 16, or working surface, of the first brace 12, as indicated by arrow 42.

Figure 4:
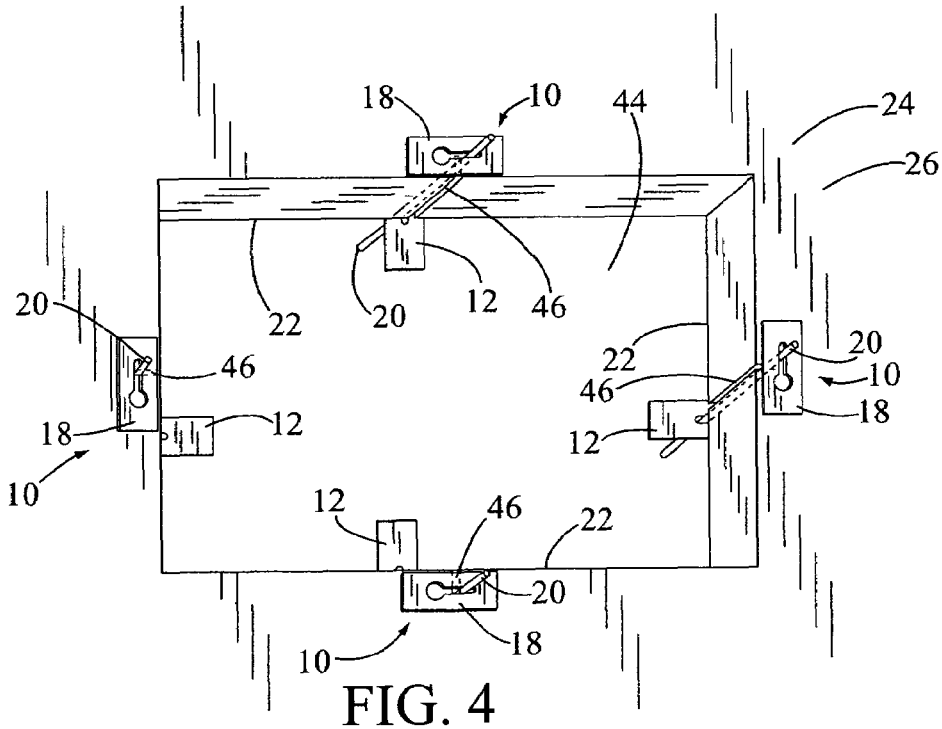
FIG. 4 is a perspective view of the large hole in the sheet rock wall with four of the repair kits used on four sides of the large hole.

In FIG. 4, a perspective view of a large hole 44 in the wall 26 is shown requiring in this example, four repair kits 10 attached to four sides of the hole 44. Four of the first braces 12, with adhesive 14 applied to the portion of each brace 12, are secured to the inside of the wall 26 next to the hole 44 using the compression tubes 20 and the second braces 18 as shown. In this example, slits 46 are cut approximately ½ inch into the sides of the hole for receiving a portion of the tubes 20 and holding a portion of the first braces 12 and adhesive 14 against the inside 22 of the hole 44. Also, a portion of the first braces 12 extend inwardly into the hole and at right angles to the sides of the hole. In this manner, the four first braces 12 provide a working surface for receiving a wall insert 48, which is slightly less than the dimensions of the large hole 44. The wall insert 48 is shown in FIGS. 5, 6 and 7.

Figure 5:
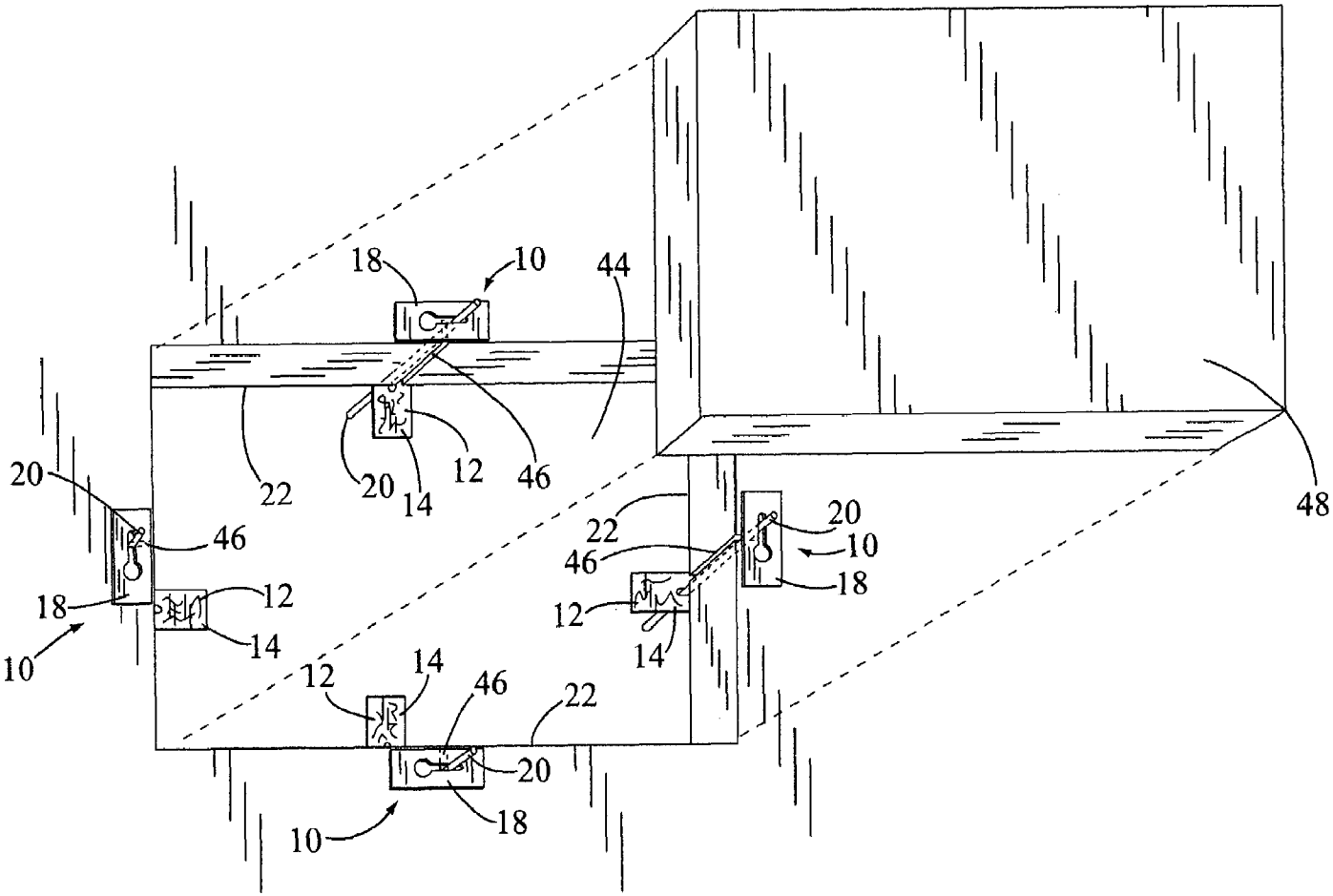
FIG. 5 is a perspective view of a replacement piece of sheet rock positioned for inserting into the large hole and attaching it to a portion of four first braces attached to the inside of the wall next to the large hole.

In FIG. 5, the wall insert 48 is shown positioned for receipt in the large hole 44. A portion of the first braces 46 extend inwardly into the back of the hole 44 for forming a working surface. The adhesive 14 is now applied to this portion of the first braces 46 for engaging a portion of the inside of the insert 48, when it's received in the large hole 44.

Figure 6:
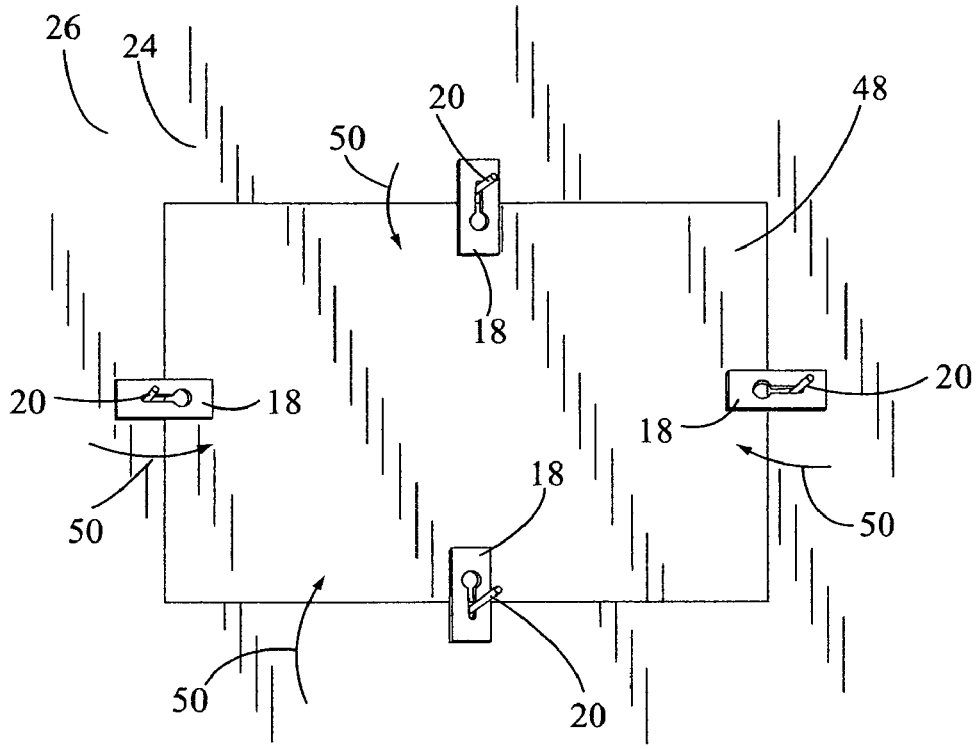
FIG. 6 is a perspective view of four second braces holding the replacement piece of sheet rock in place while an adhesive dries on the first braces to the inside of the replacement piece.

In FIG. 6, the four second braces 20 have been rotated, as indicated by arrows 50, at right angles to the sides of the wall insert 48 for holding it in place while the adhesive 14 on the first braces 46 dries and secures the insert in the large hole 44. When the adhesive has dried, the second braces 20 are removed and the compression tubes 20 are pulled tight and cut flush with the top of the slits 46. The tubes 20, when cut, will then spring back into the wall, out of the way.

Figure 7:
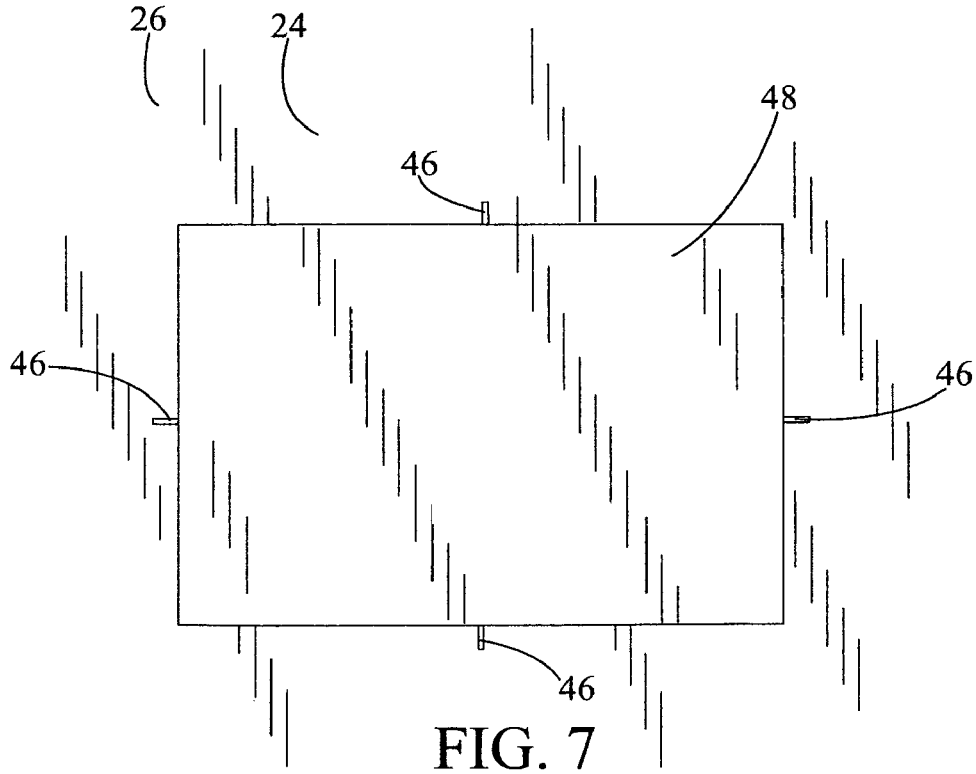
FIG. 7 is a perspective view of the completed repair of the large hole and ready for sanding and painting.

In FIG. 7, the repair of the large hole 44 is completed with the wall insert 48 secured therein. The top of the slits 46 and the sides of the insert can now be filled with spackle, sanded and then painted to complete the wall repair project.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which an exclusive privilege and property right is claimed are defined as follows:

1. A wall and door hole repair kit for repairing a hole in the wall or door, the repair kit comprising:

a first brace and a second brace, said first and second braces have the same width and length, said first and second braces including a tube opening with a tube slit next to said tube opening;

a tube received through said tube openings in said first and second braces, a portion of said tube inserted in said slits to hold said braces firmly against an inside and outside of the wall or door and next to the hole; and securing means disposed on an inside surface of said first brace, said securing means used for securing said first brace to the inside of the wall or door and next to the hole;

whereby, when said first brace is secured to the inside of the wall or door, said second brace is removed and the hole is filed with wood putty, spackle and the like and using said first brace as a working surface inside the hole.

2. The repair kit as described in claim 1 wherein said securing means is an adhesive.

3. The repair kit as described in claim 1 wherein said first brace has a width dimensioned for receipt in the hole.

4. The repair kit as described in claim 1 wherein said first and second braces are thin sheet first and second braces.

5. The repair kit as described in claim 1 wherein said tube openings are round tube openings and said slits are tube compression slits.

6. The repair kit as described in claim 1 wherein said tube is a compression tube.

7. A wall and door hole repair kit for repairing a hole in the wall or door, the repair kit comprising:

a thin sheet first brace and a thin sheet second brace, a width of one or both of said braces is adapted for receipt inside the hole, said first and second braces including a round tube opening with a tube compression slit next to said tube opening;

a compression tube received through said tube openings in said first and second braces, a portion of said tube inserted in said compression slits to hold said braces firmly against an inside and outside of the wall or door and next to the hole; and an adhesive applied to an inside surface of said first brace, said adhesive used for securing said first brace to the inside of the wall or door and next to the hole;

whereby, when said adhesive dries, said second brace is removed and the hole is filed with wood putty, spackle and the like and using said first brace as a working surface inside the hole.

8. The repair kit as described in claim 7 further including a plurality of first and second braces and a plurality of compression tubes and adapted for attaching to sides of a large hole in the wall or door.

9. A method of repairing a hole in the wall or door using a repair kit having a first brace and a second brace, a width of one or both of said braces is adapted for receipt inside the hole, the braces including a round tube opening with a tube compression slit next to the tube opening and a compression tube, the steps comprising:

inserting a portion of the tube through the tube openings in the first and second braces;

inserting a portion of the tube in the compression slit in the first brace;

applying an adhesive to a surface of the first brace;

inserting the first brace through the hole with a portion of the first brace engaging an inside of the wall or door and next to the hole;

inserting a portion of the tube in the compression slit in the second brace and securing the second brace against an outside of the wall or door and next to the hole;

allowing time for the adhesive to dry and then removing the second brace from the tube and trimming the tube inside the hole; and filing the wall with wood putty, spackle and like repair filler material using the first brace as a working surface inside the hole.

* * * * *